United States Patent [19]

Ootsuka et al.

[11] Patent Number: 4,879,139

[45] Date of Patent: Nov. 7, 1989

[54] METHOD OF MAKING A THIN FILM ELECTROLUMINESCENCE ELEMENT

[75] Inventors: Yoshinori Ootsuka; Kinya Atsumi, both of Okazaki; Masumi Arai, Nukata; Tadashi Hattori, Okazaki, all of Japan

[73] Assignee: Nippon Soken, Inc., Nishio, Japan

[21] Appl. No.: 212,023

[22] Filed: Jun. 23, 1988

Related U.S. Application Data

[63] Continuation-in-part of Ser. No. 937,482, Dec. 3, 1986, abandoned.

[30] Foreign Application Priority Data

Dec. 25, 1985 [JP] Japan ..... 60-295656

[51] Int. Cl.[4] ..... B05D 3/06

[52] U.S. Cl. ..... 427/38; 427/66; 427/109; 427/126.3; 427/126.4; 427/255.7; 427/294; 427/348; 427/350; 427/419.3; 427/419.7

[58] Field of Search ..... 427/38, 39, 66, 109, 427/126.3, 126.4, 294, 255.7, 348, 350, 419.3, 419.7

[56] References Cited

U.S. PATENT DOCUMENTS

| | | | |
|---|---|---|---|
| 3,449,748 | 6/1969 | Shortes | 427/70 |
| 4,394,601 | 7/1983 | Takeda et al. | 313/509 |
| 4,590,128 | 5/1986 | Kawai | 313/509 X |
| 4,602,189 | 7/1986 | Panicker | 313/509 X |
| 4,613,546 | 9/1986 | Kuwata et al. | 313/509 X |
| 4,634,639 | 1/1987 | Kawai | 313/509 X |

FOREIGN PATENT DOCUMENTS

| | | |
|---|---|---|
| 59-127969 | 7/1983 | Japan . |
| 2039146 | 7/1980 | United Kingdom . |

*Primary Examiner*—Bernard Pianalto

*Attorney, Agent, or Firm*—Cushman, Darby & Cushman

[57] ABSTRACT

An EL element is composed of a glass base plate, a transparent electrode, a dielectric body layer, a luminous body layer, another dielectric body layer and a rear electrode which are piled on each other in order. An an electron inflow restraining layer is formed between the luminous body layer and another dielectric body layer. The luminous body layer is formed by doping Mn into a ZnS crystal and the electron inflow restraining layer is formed by irradiating gas ions of high energy to the surface of the luminous body layer. The electron inflow restraining layer restrains the inflow of electrons supplied to the luminous body layer while being accelerated by an electric field formed between the transparent electrode and the rear electrode.

10 Claims, 2 Drawing Sheets

METHOD OF MAKING A THIN FILM ELECTROLUMINESCENCE ELEMENT

This is a continuation-in-part of application Ser. No. 937,482 filed Dec. 3, 1986 which was abandoned upon the filing hereof.

BACKGROUND OF THE INVENTION

1. Field of the Invention

The present invention relates to a thin film electroluminescence element which emits light of high luminance by applying an AC voltage thereto, and more particularly to an electroluminescence element with a luminance that can be easily controlled.

2. Description of the Prior Art

A thin film electroluminescence(hereinafter called EL) element is composed of a semiconductor luminous layer formed by doping an impurity such as Mn, Cu, $TbF_3$ and the like into a crystal body of Zns, ZnSe or the like. The above impurity acts as an active material for forming a luminescence center. By applying an AC field to the semiconductor luminous layer, EL luminescence is obtained.

It is well known to use a thin film EL element having a double layered insulation construction obtained by covering both surfaces of the luminous layer with dielectric films made of $Y_2O_3$, $Si_3N_4$, $Al_2O_3$, $TiO_2$ or the like for increasing the luminance of light emitted thereby.

One example of this thin film EL element having such a double layered insulation construction is shown in FIG. 5.

In FIG. 5, on a glass base plate 1 are formed a transparent electrode 2 made of $In_2O_3$, $SnO_2$or the like and a first dielectric film layer 3 (hereinafter called dielectric body layer) made of $Y_2O_3$, $Si_3N_4$, $Al_2O_3$, $TiO_2$ or the like by sputtering or electron beam evaporating.

On the first dielectric body layer 3, is formed a ZnS luminous body film layer 4 (hereinafter called a luminous body layer) by electron beam evaporating. In this case, a predetermined density of Mn is mixed into the luminous body layer 4 for forming a luminescence center. On the ZnS luminous body layer 4 is piled a second dielectric body layer 5 made of a material similar to that of the first dielectric body layer 3. Then, on the second dielectric body layer 5 is formed a rear electrode 6 made of Al or the like by an evaporating method. An AC power source 7 is connected between the transparent electrode 2 and the rear electrode 6.

When an AC voltage is applied between the transparent electrode 2 and the rear electrode 6, the above described AC voltage appears between the dielectric body layers 3 and 5 on both sides of the ZnS luminous body layer 4 thereby to produce an electric field within the ZnS luminous body layer 4.

By virtue of the electric field within the ZnS luminous body layer 4, electrons obtain a sufficiently large energy, and these electrons (hereinafter called hot electrons) cause the Mn luminescence center to emit orange light when the luminescence center returns to its normal state.

The thin film EL element having the above described structure can be used as a thin display device in output display terminals of a computer or in other various display devices.

When this EL element is used as the display device, a large number of parallel transparent electrodes 2 and a large number of parallel rear electrodes 6 are formed like bands, respectively, and are arranged so as to cross at right angles into a matrix electrode construction. One crossing point of one transparent electrode 2 and one rear electrode 6 composes one picture element.

In the display device using the thin film EL element, the operation voltage thereof is low as compared with the conventional cathode-ray-tube and the weight and the strength thereof are excellent as compared with a plasma display panel which is a similar flat type display device.

Furthermore, the display device using the thin film EL element has a wide operable temperature range, a high response speed and other many advantages as compared with a liquid crystal panel.

In addition, the operational life of the display device using the thin film EL element is long because of the solid state matrix panel.

However, in the conventional thin film EL element, the luminance thereof is rapidly increased in the vicinity of $V_{th}$ (the threshold of luminance) as shown by the line X of FIG. 3. This results in it being difficult to linearly control the luminance by adjusting the voltage becoming applied thereto.

SUMMARY OF THE INVENTION

One object of the present invention is to provide an EL element having a gentle voltage-luminance characteristic in the vicinity of the threshold of the applied voltage and capable of linearly controlling the luminance thereof.

The thin film electroluminescence element according to the present invention comprises a transparent base plate, a luminous body layer provided on the transparent base plate, the luminous body layer having a luminescence center formed by doping an impurity within a crystal basic material, the luminous body layer emitting light from the luminescence center due to the inflow of electrons accelerated in an electric field, a transparent electrode provided between the luminous body layer and the transparent base plate, a rear electrode provided on the luminous body layer so as to be opposed to the transparent electrode for forming the electric field, a dielectric body film layer provided in at least one of contact surfaces between the transparent electrode and the luminous body layer and between the rear electrode and the luminous body layer, an electron inflow restraining layer provided in at least one contact surface between the dielectric body film layer and the luminous body layer, the electron inflow restraining layer restraining the inflow of the electrons, from the interface of the luminous body layer with the dielectric body film layer, into the luminous body layer.

In the EL element having the above described structure, the electron inflow restraining layer restrains the electron inflow from the interface of the luminous body layer with the dielectric body layer into the luminous body layer.

This results in the luminance characteristic of the EL element gently rising up without rapidly increasing in the vicinity of the threshold of the applied voltage.

Therefore, the luminance of the EL element linearly changes in accordance with the linear change of the voltage applied to the EL element.

BRIEF DESCRIPTION OF THE DRAWINGS

FIGS. 6 and 7 show a sectional view of another embodiment according to this invention.

DETAILED DESCRIPTION OF THE INVENTION

Figure 1:
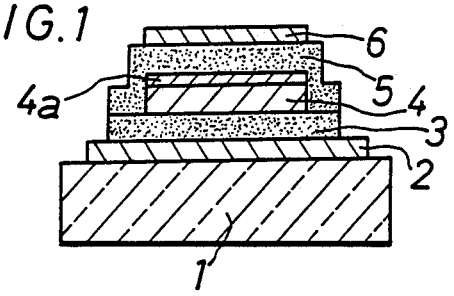
FIG. 1 is a sectional view illustrating the construction of an EL element according to the present invention.

FIG. 1 illustrates the construction of an EL element according to the present invention.

On a glass base plate 1 are piled a transparent electrode 2, a first dielectric body layer 3, a luminous body layer 4, a second dielectric body layer 5 and a rear electrode 6 in order. This fundamental construction is similar to that of the conventional EL element.

In the EL element according to the present invention however, an electron inflow restraining layer 4a is formed in the contact surface between the luminous body layer 4 and the second dielectric body layer 5 for restraining hot electron inflow into the luminous body layer 4.

The device and the method for forming the EL element having the above described structure will be explained with reference to FIG. 2.

Figure 2:
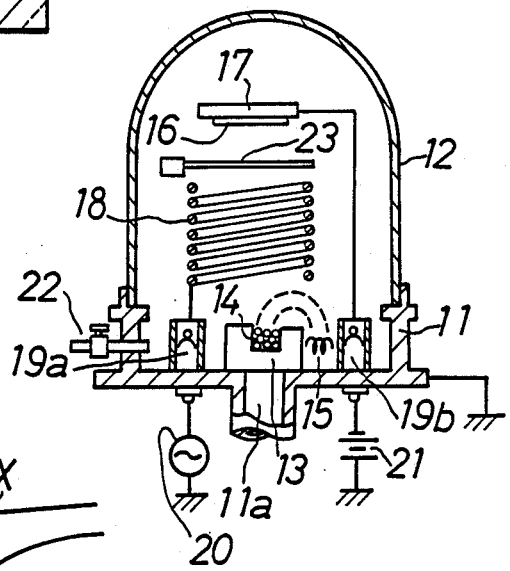
FIG. 2 is a schematic sectional view of a device for forming the EL element shown in FIG. 1.

In FIG. 2, a bell jar 12 is disposed on a base plate 11 to compose a vacuum chamber. The exhaust of the vacuum chamber is performed by means of a vacuum pump (not shown) from an exhaust port 11a. On a hearth 13 is disposed an evaporation material 14. The evaporation material 14 is heated by an electron beam from a filament 15 of an electron gun(not shown). A base plate glass 16 is fixed to a base plate holder 17. The base plate holder 17 is electrically insulated from the vacuum chamber. To the base plate glass 16 is usually applied a voltage of about −300 V to −1200 V by a DC bias power source 21 through a current inlet terminal 19b.

An electric discharge coil 18 is disposed within the vacuum chamber and is connected to a high frequency power source 20 through the current inlet terminal 19a.

A gas inlet port 22 is provided in the base plate 11 of the vacuum chamber. A reference numeral 23 designates a shutter.

Hereinafter, the producing process of the EL element will be explained.

At first, the transparent electrode 2 and the first dielectric body layer 3 are formed on the glass base plate 1 by electron beam evaporating. And then, the evaporation material 14 for forming the luminous body layer 4 (ZnS crystal in which Mn is doped, for example) is evaporated on the first dielectric body layer 3 by electron beam thereby to form the luminous body layer 4.

Next, gas is introduced into the vacuum chamber from the gas inlet port 22 to a predetermined pressure (about 0.1 to 10 pa).

Inactive gas such as Ar, Ne and $N_2$ or $O_2$ gas is used as the gas to be introduced into the vacuum chamber. The introduced gas is ionized due to the high frequency discharge of the electric discharge coil 18.

At this time, negative bias voltage is applied to the base plate holder 17 as described above. The ionized gas atoms are accelerated toward the base plate holder 17 by virtue of the electric field, and collide with the formed luminous body layer 4 to thereby to form the electron inflow restraining layer 4a on the luminous body layer 4.

Thereafter, the second dielectric body layer 5, and the rear electrode 6 are formed by an electron beam evaporation method, thereby obtaining the EL element shown in FIG. 1.

Hereinafter, the luminance characteristic of the EL element according to the present invention is compared with that of the conventional EL element with reference to FIG. 3 and the effect of the present invention will be explained.

Figure 3:
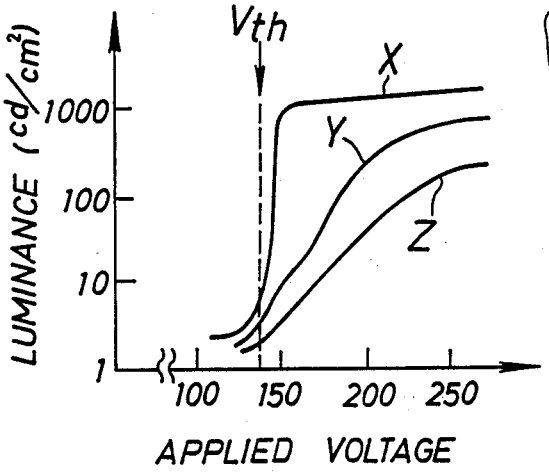
FIG. 3 is a graph wherein the luminance characteristic of the EL element according to the present invention is compared with that of the conventional element.

In FIG. 3, the curved line X denotes the luminance characteristic of the conventional EL element of which the luminous body layer 4 is not subjected to an ion irradiation processing. This curved line X rapidly rises up in the vicinity of the threshold voltage $V_{th}$ of the applied voltage.

The curved line Y denotes the luminance characteristic of the EL element provided with the electron inflow restraining layer which is formed by ion irradiating with a comparatively low bias voltage. The maximum luminance slightly drops as compared with the case that the ion irradiation process is not effected. However, the luminance gently increases over the threshold voltage $V_{th}$ in a nearly linear relation with voltage.

The curved line Z denotes the luminance characteristic of the EL element which is ion irradiated by a higher bias voltage. The maximum luminance of this element further drops. However, the luminance thereof varies almost linearly as the voltage varies.

The above experimental results are due to the fact that a crystal structure of ZnS is destructed in the surface of the luminous body layer 4 to which ion beam is irradiated. This results in the crystallinity of ZnS being lowered.

The hot electrons supplied from the interface between the second dielectric body layer 5 and the luminous body layer 4 are restrained from flowing into the luminous body layer 4 by the electron inflow restraining layer 4a of low crystallinity. This results in the luminance not rapidly rising up and the luminance characteristic being linearly varied.

In the EL element of which the luminance characteristic is almost linear, the luminance gradually varies in accordance with the variation of the applied voltage.

Therefore, the EL element according to the present invention can be used for increasing its luminance in proportion to the rotating speed as a display member of a speed indicator, for example.

Using the EL element according to the present invention, the luminance does not largely change even if the applied voltage to the EL element changes with the passage of time to a certain value.

Figure 4:
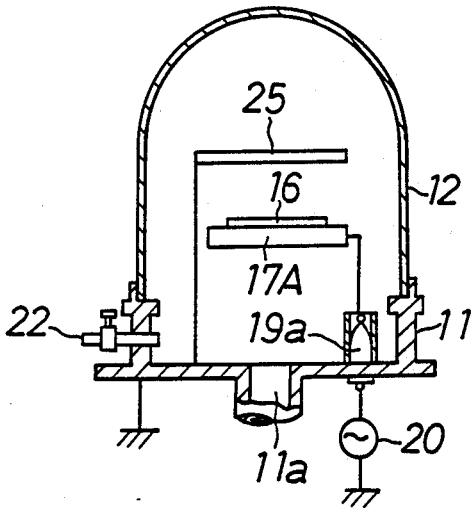
FIG. 4 is a schematic sectional view of another device for forming the EL element shown in FIG. 1.
Figure 5:
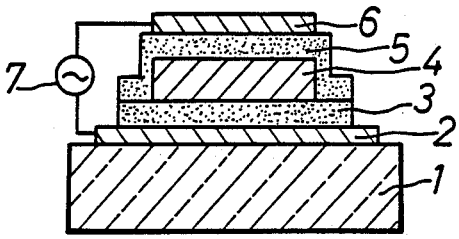
FIG. 5 PRIOR ART
FIG. 5 is a sectional view illustrating the construction of the conventional EL element.

The ion irradiation to the luminous body layer 4 can be effected by capacitive discharge other than the above described inductive discharge as shown in FIG. 4.

In FIG. 4, the base plate holder 17A is connected to the high frequency power source 20 through the current inlet terminal 19a. An opposite electrode 25 is connected to the base plate 11 and is grounded.

When gas such as Ar, Ne, $N_2$, $O_2$ is introduced into the vacuum chamber from the gas inlet port 22 to a predetermined pressure (about 0.1 Pa to 10 Pa) and high frequency voltage is applied to the base plate holder 17A, the capacitive discharge starts between the base plate holder 17A and the opposite electrode 25 to produce ions.

The produced ions are accelerated towards the base plate holder 17A and irradiate the luminous body layer 4 on the base plate glass 16 to form an electron inflow restraining layer 4a.

The present embodiment has effects similar to those of the preceding embodiment.

Two additional modified embodiments of the present invention are shown in FIGS. 6 and 7. According to these modified embodiments, the dielectric body film layer 5 may be formed on one side of the luminous body layer 4. FIGS. 6 and 7 use same reference numerals as those of the previous embodiments.

Ordinarily, at least one of the two electrodes may be composed of a transparent electrode. According to another aspect of this modified embodiment, both electrodes can be formed by transparent electrodes.

The present invention is not limited to the ion irradiation by the above described inductive discharge and capacitive discharge. Instead, the ion irradiation by means of an ion gun, the electron beam irradiation by means of a filament, or other high energy particles irradiation will do.

The thin film EL element according to the present invention is not limited to the double-layered insulation structure. In addition, the MIS structure will do.

What is claimed is:

1. A method of forming a thin film electroluminescent element comprising the steps of:

forming a luminous body layer having a crystal basic material and a luminescence center, on a transparent base plate; and doping an impurity within said crystal basic material so that the doped luminous body layer will emit light from said luminescence center in response to an inflow of electrons accelerated in an electric field;

forming a transparent electrode between said luminous body layer and said transparent base plate;

forming a rear electrode on said luminous body layer opposed to said transparent electrode in a way such that an electric field can be formed between said rear electrode and said transparent electrode;

at least one dielectric body film layer provided between at least one of said transparent electrode and said rear electrode, and said luminous body layer; and causing high energy particles to collide against a surface of the luminous body layer to destroy the crystal structure of at least a portion thereof and to form at least one electron inflow restraining layer in said luminous body layer in contact with said at least one dielectric body film layer, said electron inflow restraining layer restraining an inflow of said electrons from the interface of said luminous body layer with said dielectric body film layer into said luminous body layer.

2. A method for forming a thin film electroluminescence element comprising the steps of:

forming a first electrode on a transparent base plate;

disposing an evaporation material and said transparent base plate on which said first electrode is formed, within a vacuum chamber;

heating said evaporation material to form a luminous body layer on said first electrode;

generating gas ions and causing said gas ions to collide against an upper surface of said luminous body layer to physically change said surface to form an electron inflow restraining layer for restraining hot electron inflow into said luminous body in said luminous body layer;

forming a dielectric body film layer on said electron inflow restraining layer; and forming a second electrode on said dielectric body film layer.

3. A method according to claim 2, wherein said gas ions are one of inactive gas ions and $O_2$ gas ions.

4. A method according to claim 2, comprising the further steps of:

generating said gas ions within said vacuum chamber by a high frequency discharge on a gas introduced into said vacuum chamber; and causing said gas ions to collide against said upper surface of said luminous body layer by applying a negative bias voltage to said base plate.

5. A method for forming a thin film electroluminescence element comprising the steps of:

forming a first electrode on a transparent base plate, and forming a dielectric body film layer on said first electrode;

disposing an evaporation material and said transparent base plate on which said first electrode and said dielectric body film layer are formed, within a vacuum chamber;

heating said evaporation material to form a luminous body layer on said dielectric body film layer;

generating gas ions and colliding said gas ions against an upper surface of said luminous body layer to physically change said surface to form an electron inflow restraining layer for restraining hot electron inflow into said luminous body layer in said luminous body layer; and forming a second electrode on said electron inflow restraining layer.

6. A method according to claim 5, wherein said gas ions are one of inactive gas ions and $O_2$ gas ions.

7. A method according to claim 5, comprising the further steps of:

generating said gas ions within said vacuum chamber by a high frequency discharge on a gas introduced into said vacuum chamber; and colliding said gas ions against said upper surface of said luminous body layer by applying a negative bias voltage to said base plate.

8. A method for forming a thin film electroluminescence element comprising the steps of:

forming a first electrode on a transparent base plate and forming a first dielectric body film layer on said first electrode;

disposing an evaporation material and said transparent base plate on which said first electrode and said first dielectric body film layer are formed, within a vacuum chamber;

heating said evaporation material to form a luminous body layer on said first dielectric body film layer;

generating gas ions and colliding said gas ions against an upper surface of said luminous body layer to physically change said surface, to form an electron inflow restraining layer for restraining hot electron inflow into said luminous body layer in said luminous body layer; and forming a second dielectric body film layer on said electron inflow restraining layer and forming a second electrode on said second dielectric body film layer.

9. A method according to claim 8, wherein said gas ions are one of inactive gas ions and $O_2$ ions.

10. A method according to claim 8, comprising the further steps of introducing a gas into said chamber;

causing a high frequency discharge in said chamber to generate said gas ions; and causing said gas ions to collide against said upper surface of said luminous body layer by applying a negative bias voltage to said base plate.

* * * * *